US008351832B2

(12) United States Patent
Kamijo et al.

(10) Patent No.: US 8,351,832 B2
(45) **Date of Patent: *Jan. 8, 2013**

(54) IMAGE FORMING APPARATUS WITH RECESSED TRANSFER ROLLER INCLUDING GRIPPERS

(75) Inventors: Koichi Kamijo, Matsumoto (JP); Satoshi Chiba, Suwa (JP); Shinichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 319 days.

This patent is subject to a terminal disclaimer.

(21) Appl. No.: 12/762,136

(22) Filed: Apr. 16, 2010

(65) Prior Publication Data

US 2010/0266318 A1 Oct. 21, 2010

(30) Foreign Application Priority Data

Apr. 17, 2009 (JP) ..... 2009-100877

(51) Int. Cl.
*G03G 15/01* (2006.01)

(52) U.S. Cl. ..... 399/304; 399/121; 399/297; 399/316; 399/388

(58) Field of Classification Search ..... 399/121, 399/297, 304, 316, 388
See application file for complete search history.

(56) References Cited

U.S. PATENT DOCUMENTS

| | | | | |
|---|---|---|---|---|
| 3,702,482 | A * | 11/1972 | Dolcimascolo et al. | 399/297 |
| 4,723,145 | A | 2/1988 | Takada et al. | |
| 5,016,056 | A | 5/1991 | Johnson et al. | |
| 5,325,155 | A | 6/1994 | Perry | |
| 6,163,676 | A | 12/2000 | Levanon et al. | |
| 6,243,556 | B1 | 6/2001 | Shin | |

FOREIGN PATENT DOCUMENTS

| | | |
|---|---|---|
| JP | 03-004241 | 1/1991 |
| JP | 2000-508280 T | 7/2000 |
| JP | 3128067 B | 9/2000 |
| WO | 97/09262 | 3/1997 |

OTHER PUBLICATIONS

U.S. Appl. No. 12/759,494, filed Apr. 13, 2010, Kamijo et al.
U.S. Appl. No. 12/759,494, Mail Date Mar. 23, 2012, Office Action.
U.S. Appl. No. 12/759,494, Mail Date Jul. 16, 2012, Notice of Allowance.

* cited by examiner

*Primary Examiner* — Ryan Walsh
(74) *Attorney, Agent, or Firm* — Workman Nydegger

(57) ABSTRACT

An image forming method includes: feeding a transfer material to a transfer portion by gate rollers; contacting the transfer material with a transfer material grip member that is disposed on a transfer roller; holding the transfer material on an elastic holding portion which holds the transfer material disposed on the circumference surface of the transfer roller; transferring the transfer material held by the holding portion; and transferring an image at the transfer portion.

8 Claims, 14 Drawing Sheets

IMAGE FORMING APPARATUS WITH RECESSED TRANSFER ROLLER INCLUDING GRIPPERS

The entire disclosure of Japanese Patent Application No: 2009-100877, filed Apr. 17, 2009 is expressly incorporated by reference herein.

BACKGROUND

1. Technical Field

The present invention relates to a transfer device, an image forming method and an image forming apparatus in an electrophotographic system.

2. Related Art

Proposed is an image forming apparatus with a transfer device that visualizes a latent image of an image carrier by developing it with a developing unit and transfers the toner image on the image carrier directly to a transfer material, such as paper. Furthermore, proposed is an image forming apparatus with a transfer device that visualizes a latent image of an image carrier by developing it with developing units, and then transfers the toner image on the image carrier onto an intermediary transfer medium, such as a drum or a belt stretched across a plurality of rollers, from whence the toner image on the intermediary transfer medium is transferred to a transfer material.

Disclosed in JP-A-3-4241 is an imaging unit that develops a latent image, which is on a photoreceptor functioning as an image carrier, into a toner image; and includes a transfer drum that transfers the toner image on the photoreceptor onto the transfer material. This transfer drum includes transfer material grip members for holding the transfer material, an adsorption electrostatic charger for electrostatically adsorbing the transfer material onto the transfer drum, a transfer electrostatic charger for transferring the toner image on the photoreceptor onto the transfer material, and a releasing electrostatic charger for releasing the transfer material, to which the toner image has been transferred from the transfer drum.

Disclosed in JP-T-2000-508280 is an image forming apparatus equipped with a transfer drum in which a latent image on a photoreceptor is developed with a liquid developer into a toner image; then, the toner image on the photoreceptor is transferred to an intermediary transfer drum that functions as an intermediary transfer medium; and the toner image on the intermediary transfer drum is transferred to a transfer material. The toner image on the intermediary transfer drum is transferred to the transfer material by applying heat and pressure. In addition, the transfer drum has transfer material grip members that grip the transfer material. It also has detach members on the outside of the transfer drum, which serves to release the transfer material from the transfer drum.

The image forming apparatus disclosed in JP-A-3-4241 requires a plurality of electrostatic chargers such as the adsorption electrostatic charger, the transfer electrostatic charger, and the releasing electrostatic charger within the transfer drum, making for a structurally complicated device as well as causing difficulties for controlling the positioning of the transfer material. In addition, because the image forming apparatus disclosed in JP-T-2000-508280 uses applied heat and pressure to transfer the toner image onto the transfer material, the adhesion between the transfer material, onto which the toner image has been transferred, and the transfer drum is increased, making it difficult to release the transfer material from the transfer drum as well as causing difficulties for positioning the transfer material.

SUMMARY

An advantage of some aspects of the invention is to provide an image forming method and an image forming apparatus capable of positioning the transfer material precisely and improving the transfer property of the image on the image carrier to the transfer material.

The image forming method according to an aspect of the invention includes; feeding a transfer material to a transfer portion by gate rollers, contacting the fed transfer material with transfer material grip members that are disposed on a transfer roller, after contacting the transfer material with the transfer material grip members, holding the transfer material on an elastic holding portion which holds the transfer material disposed on the perimeter surface of the transfer roller, transporting the transfer material held by the holding portion, and transferring an image at the transfer portion. In this manner, the positioning of the transfer material is precisely aligned, enabling an improved transfer of an image of the image carrier onto the transfer material.

Furthermore, the image forming method according to an aspect of the invention includes; guiding the transfer material, which has been fed out by the gate rollers, with a transfer material feed guide and contacting the transfer material guided by the transfer material feed guide with the transfer material grip members. This method enables to prevent the transfer material from coming in contact with the holding portion during its feed process and also prevents fluctuations in the feed speed while precisely aligning the position of the transfer material.

Additionally, the image forming method according to an aspect of the invention includes; while the transfer roller having a recessed portion where the transfer material grip members are located, contacting the transfer material with the transfer material grip members when the recessed portion moves to the transfer portion, and the image carrier is separated from the transfer roller. Gripping the transfer material at the point where the recessed portion is in a position opposite the image carrier enables the transfer material to be gripped stably and without any troubles from the contact with the image carrier that may cause fluctuations in speed.

Moreover, the image forming apparatus according to an aspect of the invention includes: an image carrier that carries an image; a transfer roller that has a holding portion made of elastic member that comes in contact with the image carrier, and a recessed portion on the circumference surface, and transfer material grip members that are located inside the recessed portion to grip the transfer material, and a support member, with which the transfer material grip members come in contact through the transfer material; and gate rollers that feed the transfer material to the nip portion formed by the contact between the image carrier and the transfer roller; and the contact position of the transfer material grip members and the transfer material is set so as an imaginary line between the feeding position of the transfer material by the gate rollers and the contact position of the transfer material and the transfer material grip members not to intersect with the circumference surface of the holding portion of the transfer roller. This configuration prevents the transfer material from coming in contact with the holding portion, and prevents fluctuations in speed, etc. that may arise from the contact, enabling the precise position alignment of the transfer material.

Additionally, the image forming apparatus according to an aspect of the invention includes: an image carrier that carries the image; a transfer roller that has a holding portion made of elastic member that comes in contact with the image carrier, a recessed portion on the circumference surface, transfer material grip members that are located inside the recessed portion to grip the transfer material, and a support member to support the transfer material coming in contact with the transfer material grip members through the transfer material; gate rollers that feed the transfer material to the nip portion formed by the contact between the image carrier and the transfer roller; a transfer material feed guide to guide the transfer material fed by the gate rollers; and when the transfer roller is rotated in a manner in which the transfer material grip members intersect at the point of an imaginary line extended in a direction of feed of the transfer material and passing through the transfer material feed guide, the transfer material feed guide is disposed for the imaginary line so as not to intersect with the circumference surface of the holding portion. This configuration prevents the transfer material from coming in contact with the holding portion and thereby preventing fluctuations in speed, etc. of the transfer material and enabling the precise position alignment of the transfer material.

Another aspect of the image forming apparatus of the invention provides that the intersecting portion between the recessed portion and the circumference surface of the transfer roller is flat. This configuration prevents the transfer material from coming in contact with the holding portion and thereby preventing fluctuations in speed, etc. of the transfer material and enabling the precise position alignment of the transfer material.

Another aspect of the image forming apparatus of the invention provides that the intersecting portion between the recessed portion and the circumference surface of the transfer roller is rounded. This configuration prevents the transfer material from coming in contact with the holding portion and thereby preventing fluctuations in speed, etc. of the transfer material and enabling the precise position alignment of the transfer material.

Another aspect of the image forming apparatus of the invention provides that the position of the image to be transferred onto the transfer material is secured by the transfer material grip members and the support member. This enables the precise position alignment of the transfer material and thereby improving the transfer of the image from the image carrier to the transfer material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
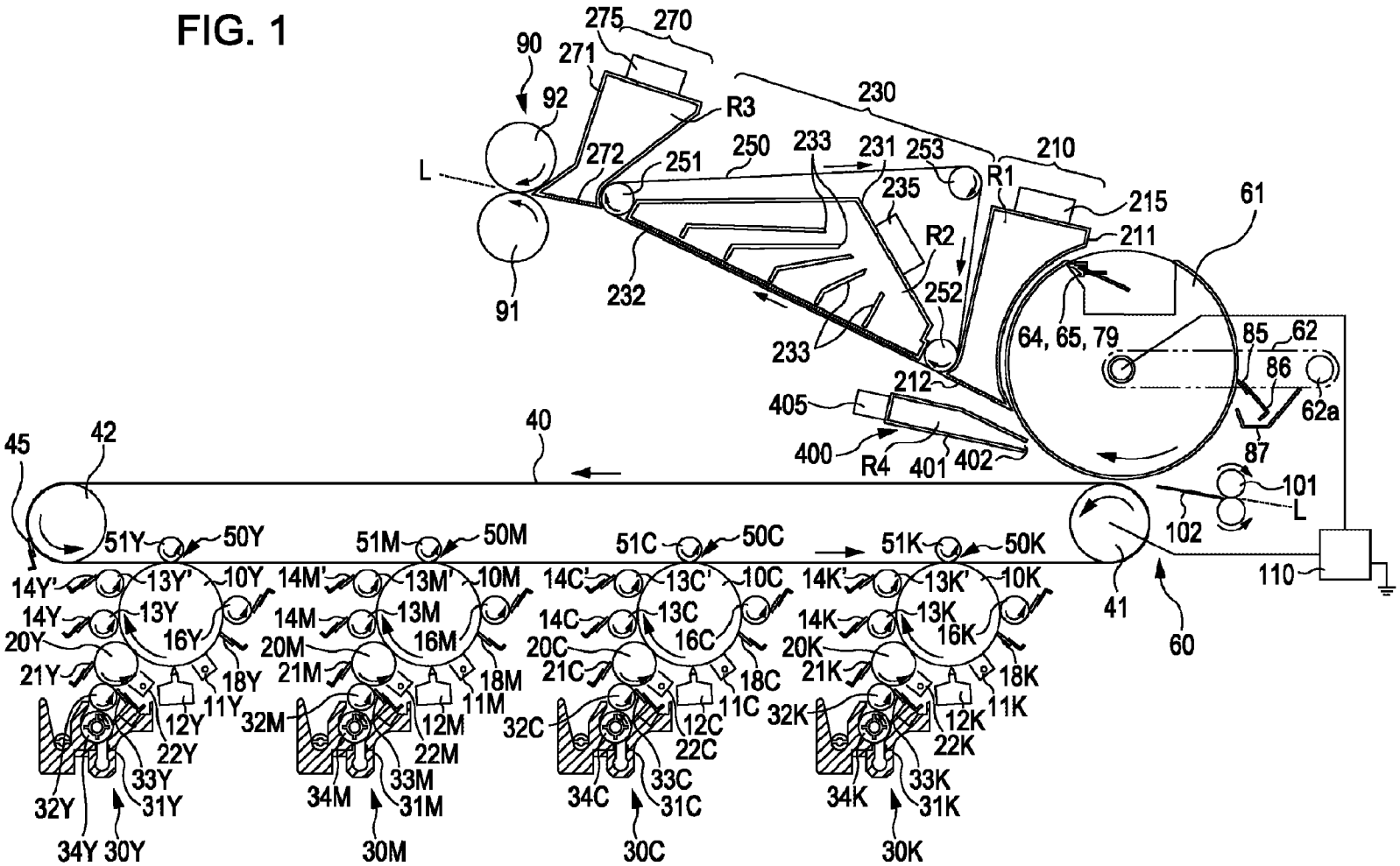
FIG. 1 is a diagram which illustrates primary components configuring an image forming apparatus that relates to an embodiment of the invention.

Here, embodiments for carrying out the invention will be described with reference to the drawings. FIG. 1 is a diagram which illustrates the primary components configuring an image forming apparatus that relates to an embodiment of the invention. In relation to the multi-color image forming units arranged in the center of the image forming apparatus, development units 30Y, 30M, 30C and 30K are placed in the lower portion of the image forming apparatus while structural elements such as a transfer belt 40, a secondary transfer unit 60, a fixing unit 90, etc. are located in the upper portion. In particular, the fact that the fixing unit 90 is laid out above the transfer belt 40 enables the area for the whole image forming apparatus to be small. This layout is made possible because this embodiment is structured so that transfer materials, such as a sheet of paper, having undergone transfer in the secondary transfer unit 60 can be suctioned by a transfer material feed unit 230 and suction units 210, 270, etc. and transported to the fixing unit 90.

In order to form an image by the development units 30Y, 30M, 30C and 30K using toner, the development units include photoreceptors 10Y, 10M, 10C and 10K, corona electrostatic chargers 11Y, 11M, 11C and 11K, and such LED arrays as exposure units 12Y, 12M, 12C and 12K. The photoreceptors 10Y, 10M, 10C and 10K are uniformly charged by the corona electrostatic chargers 11Y, 11M, 11C and 11K and then exposed based on the image signals received by the exposure units 12Y, 12M, 12C and 12K. This forms an electrostatic latent image onto the photoreceptors 10Y, 10M, 10C and 10K.

The development units 30Y, 30M, 30C and 30K generally include developer rollers 20Y, 20M, 20C and 20K; developer reservoirs 31Y, 31M, 31C and 31K filled with liquid developer in each of the colors, yellow (Y), magenta (M), cyan (C) and black (K); and anilox rollers 32Y, 32M, 32C and 32K that are application rollers that coat the developer rollers 20Y, 20M, 20C and 20K with each of the respective colors of the liquid developers from the developer reservoirs 31Y, 31M, 31C and 31K. The development of the electrostatic latent image onto the photoreceptors 10Y, 10M, 10C and 10K is performed using each of the liquid developers' colors.

The transfer belt 40 is an endless belt being stretched across a belt drive roller 41 and a tension roller 42. The transfer belt 40 is driven and rotated by the belt drive roller 41 in such a manner that it comes in contact with the photoreceptors 10Y, 10M, 10C and 10K at primary transfer portions 50Y, 50M, 50C and 50K. The primary transfer portions 50Y, 50M, 50C and 50K are aligned so that primary transfer rollers 51Y, 51M, 51C and 51K are aligned directly opposite these portions, sandwiching the photoreceptors 10Y, 10M, 10C and 10K and the transfer belt 40 in-between, making the contact positions with the photoreceptors 10Y, 10M, 10C and 10K as the transfer positions to form a full-color toner image by transferring the toner image in each of the colors in a lapping manner in order, which is on the exposed photoreceptors 10Y, 10M, 10C and 10K, onto the transfer belt 40.

In the secondary transfer unit 60, a secondary transfer roller 61 is arranged opposite the belt drive roller 41 sandwiching the transfer belt 40, a cleaning device that is a secondary transfer roller cleaning blade 62 is arranged. At the transfer point where the secondary transfer roller 61 is placed, a monochromatic toner image or a full-color toner image formed on the transfer belt 40 is transferred onto the transfer material such as paper, film or cloth, etc. being transported along a transfer material feed route L.

Furthermore, downstream from the transfer material feed route L are arranged q first suction unit 210, a transfer material feed unit 230, and a second suction unit 270 in order. They are configured to transport the transfer material to the fixing unit 90. At the fixing unit 90, the monochromatic toner image or the full-color toner image transferred onto the transfer material such as paper, etc. is fused and fixed onto the transfer material such as paper, etc.

The transfer belt 40 is stretched across the tension roller 42 and the belt drive roller 41. A cleaning device that is a transfer belt cleaning blade 45 is arranged in such a manner as to contact with the transfer belt 40 at the point where the transfer belt 40 is stretched by the tension roller 42 in order to clean the remaining toner and carrier off the transfer belt 40. Alternatively, the tension roller 42 can be furnished with the drive force to drive the transfer belt 40 using the belt drive roller 41 to act merely as a belt stretching roller.

A paper feeder (not shown) is used to feed the transfer material for the image forming apparatus. The transfer material placed in the paper feeder such as this is made to feed out one sheet at a time at regulated intervals to the transfer material feed route L. Along the transfer material feed route L, the transfer material is transported to a secondary transfer position by the gate rollers 101 and the transfer material feed guide 102 to make the developed monochromatic toner image or the developed full-color toner image that has been formed on the transfer belt 40 be transferred to the transfer material. The transfer material having undergone the secondary transfer is further transported to the fixing unit 90, primarily by the transfer material feed unit 230. The fixing unit 90 includes a heat roller 91 and a pressure roller 92. The pressure roller 92 has a designated application of pressure bias toward the heat roller 91. The transfer material is inserted into a nip space between these, to fuse and fix the monochromatic toner image or the full-color toner image onto the transfer material such as paper, etc.

The development units are discussed below. However, the configuration of the development unit and the image forming unit of each color is all the same to each other, so the following description will be based only on the yellow color (Y) image forming unit and its development unit.

The image forming unit includes a photoreceptor cleaning roller 16Y, a photoreceptor cleaning blade 18Y, a corona electrostatic charger 11Y, an exposure unit 12Y, a development roller 20Y of a development unit 30Y, a first photoreceptor squeeze roller 13Y and a second photoreceptor squeeze roller 13Y' which are all arranged around the circumference of a photoreceptor 10Y in the direction of its rotation.

By having the photoreceptor cleaning roller 16Y rotate in a counter-clockwise direction against the photoreceptor 10Y, the residual liquid developer and non-transferred liquid developer are cleaned off the photoreceptor 10Y. Bias voltage is applied to the photoreceptor cleaning roller 16Y which causes it to attract the toner particles in the liquid developer. The matter that the photoreceptor cleaning roller 16Y collects contains many toner particles making it a liquid developer rich in solid particulates.

Downstream from the photoreceptor cleaning roller 16Y, the photoreceptor cleaning blade 18Y that contacts the photoreceptor 10Y cleans off a liquid developer rich in carrier substance from the photoreceptor 10Y.

Arranged around the circumference of the development roller 20Y of the development unit 30Y are a cleaning blade 21Y, an anilox roller 32Y and a compaction corona generator 22Y. Attached to the anilox roller 32Y is a control blade 33Y that adjusts the amount of liquid developer that is supplied to the development roller 20Y. There is an auger 34Y accommodated inside the liquid developer reservoir 31Y. Additionally, the primary transfer roller 51Y of the primary transfer unit 50Y is arranged directly opposite the photoreceptor 10Y sandwiching the transfer belt 40.

The photoreceptor 10Y is a cylindrical photoreceptor drum and rotates clockwise. A photosensitive layer made up of amorphous silicon photoreceptors is formed onto the circumference surface of this photoreceptor drum.

The corona electrostatic charger 11Y is placed upstream from the nip portion between the photoreceptor 10Y and the development roller 20Y in the rotational direction of the photoreceptor 10Y. It is applied voltage from a power source (not shown), and is making corona-charging the photoreceptor 10Y. The exposure unit 12Y is located downstream from the corona electrostatic charger 11Y in the rotational direction of the photoreceptor 10Y. The exposure unit 12Y irradiates the surface of the photoreceptor 10Y, which has been charged by the corona electrostatic charger 11Y, with light, forming a latent image onto the photoreceptor 10Y. Note that with regard to the image forming process from beginning to end, the configuration of components such as rollers, etc. that are placed at an earlier position in the overall image forming process, is defined as being upstream to those elements placed in the later process.

The development unit 30Y includes a compaction corona generator 22Y that acts a compaction action and the developer reservoir 31Y that stores liquid developer. The liquid developer includes toner dispersed into a carrier at a ratio of approximately 20% by weight.

Additionally, the development unit 30Y includes the development roller 20Y that carries the aforementioned liquid developer; the anilox roller 32Y, which is a coating roller, for coating the developer rollers 20Y with the liquid developer; the control blade 33Y that controls the amount of liquid developer that is coated to the development roller 20Y; the auger 34Y that continually mixes and transports the liquid developer to the anilox roller 32Y; the compaction corona generator 22Y that compacts the liquid developer carried by the development roller 20Y; and the development roller cleaning blade 21Y that cleans the development roller 20Y.

The liquid developer stored in the developer reservoir 31Y is not a volatile liquid developer used customarily, which uses Isopar (Exxon brand) as an image carrier and has a low density (about 1 to 3 wt %) and low viscosity with volatile properties at room temperature, but a high density, high viscosity non-volatile liquid developer that has non-volatile properties at room temperature. In other words, the liquid developer used in an aspect of the invention is a liquid developer which is made by mixing solid particles, approximately 1 μm in diameter, in a thermoplastic resin to which a colorant such as a pigment has been added, and a dispersing agent into a liquid medium, such as an organic medium, silicon oil, mineral oil or cooking oil, etc. As a result, this liquid developer is a high viscous liquid developer (the viscoelasticity is approximately 30 to 300 mPa·s at a shear rate of 1000 (l/s) at 25° C. using the HAAKE RheoStress RS600) having a concentration level of toner solids that is approximately 15 to 25%.

The anilox roller 32Y supplies the liquid developer to the development roller 20Y and functions as a coating roller. The anilox roller 32Y is a cylindrical roller with minute and uniform grooves engraved in a spiral pattern making concave and convex channels on its surface, which serve to carry the developer more easily. The liquid developer is supplied by the anilox roller 32Y from the liquid developer reservoir 31Y to the development roller 20Y. The action to execute this process is carried out as shown in FIG. 1 by the auger 34Y rotating counter-clockwise to supply the anilox roller 32Y with the liquid developer and then the anilox roller 32Y rotating counter-clockwise to coat the development roller 20Y.

The control blade 33Y is a blade with elastic properties having an elastomer coating, with a rubber part, such as urethane rubber, that comes in contact with the surface of the anilox roller 32Y. The blade adjusts the volume of the liquid developer supplied to the development roller 20Y by adjusting and controlling the film thickness and the volume of the liquid developer carried over from the anilox roller 32Y.

The development roller cleaning blade 21Y is made of rubber, etc. that comes in contact with the surface of the development roller 20Y. The development roller cleaning blade 21Y is located downstream in the rotational direction of the development roller 20Y from the nip portion where the development roller 20Y and the photoreceptor 10Y contact. This arrangement enables it to scrape off and eliminate the residual liquid developer on the development roller 20Y.

The compaction corona generator 22Y is an electrical field application component for increasing electrostatic bias on the surface of the development roller 20Y. The compaction corona generator 22Y applies the electrical field in the compaction area from the direction of the compaction corona generator 22Y toward the development roller 20Y. A compaction roller, etc. can be used in place of this process of applying the electrical field for compaction, replacing the corona discharge from a corona discharger shown in FIG. 1.

The compacted developer carried by the development roller 20Y is developed by a designated electrical field application according to the latent image on the photoreceptor 10Y at the nip portion where the development roller 20Y and the photoreceptor 10Y contact.

The undeveloped developer is scraped off the development roller cleaning blade 21Y and recycled by having it drip back into the collection area of the liquid developer reservoir 31Y. Note, this recycled carrier and the toner used in this manner do not include mixed colors.

A photoreceptor squeeze unit located upstream from the first transfer is located downstream of the development roller 20Y opposite the photoreceptor 10Y and collects the surplus carrier from the toner image developed onto the photoreceptor 10Y. This photoreceptor squeeze unit includes a first photoreceptor squeeze roller 13Y that has elastic roller components and a second photoreceptor squeeze roller 13Y' which roll along the surface of the photoreceptor 10Y and collect the residual carrier and fog toner, which is originally unneeded, from the toner image developed on the photoreceptor 10Y. This, in effect, increases the ratio of toner particles in a visualized image (the toner image). Additionally, a bias voltage is applied to the photoreceptor squeeze rollers 13Y and 13Y'.

After the surface of the photoreceptor 10Y has traversed the squeeze unit, which includes the first photoreceptor squeeze roller 13Y and the second photoreceptor squeeze roller 13Y', it moves into the primary transfer unit 50Y. At the primary transfer unit 50Y, the liquid developer image developed on the photoreceptor 10Y is transferred to the transfer belt 40 by the primary transfer roller 51Y. At this primary transfer unit 50Y, the toner image on the photoreceptor 10Y is transferred onto the transfer belt 40 by a transfer bias action applied to the primary transfer backup roller 51. Here, the photoreceptor 10Y and the transfer belt 40 are arranged to move at the same speed. This configuration reduces the drive load on the rotation and the movement while also controlling any disruptive action affecting the visualized toner image on the photoreceptor 10Y.

Using the same development process performed in the development unit 30Y described above, toner images are formed in the development units 30M, 30C and 30K onto their respective photoreceptors 10M, 10C and 10K in their respective colors, magenta (M), cyan (C) and black (K). Then the transfer belt 40 traverses the nip portions of the primary transfer units 50 of each color, yellow (Y), magenta (M), cyan (C) and black (K), transferring the liquid developer (developed images) from the photoreceptors so that the colors are layered, and then moves to the nip portion of the secondary transfer unit 60.

The transfer belt 40, having traversed the secondary transfer unit 60, will revolve in order to transfer the transfer image at the primary transfer units 50 again, and upstream from the primary transfer units 50 where the transfer is executed, the transfer belt 40 is cleaned by the transfer belt cleaning blade 45.

The transfer belt 40 is constructed of three layers: an elastic intermediate layer of polyurethane in-between a polyimide base layer and a surface layer of PFA. In this manner, the transfer belt 40 is utilized so that it is stretched with the belt drive roller 41 and the tension roller 42 against the polyimide base layer while the toner image is transferred onto the PFA surface layer. Due to its good tracking and responsive qualities with regard to the transfer material, the transfer belt 40 constructed in this manner with elastic properties is effective during the secondary transfer where toner particles, which have especially small diameters, are transported and transferred into the depressions of the transfer material.

Figure 2:
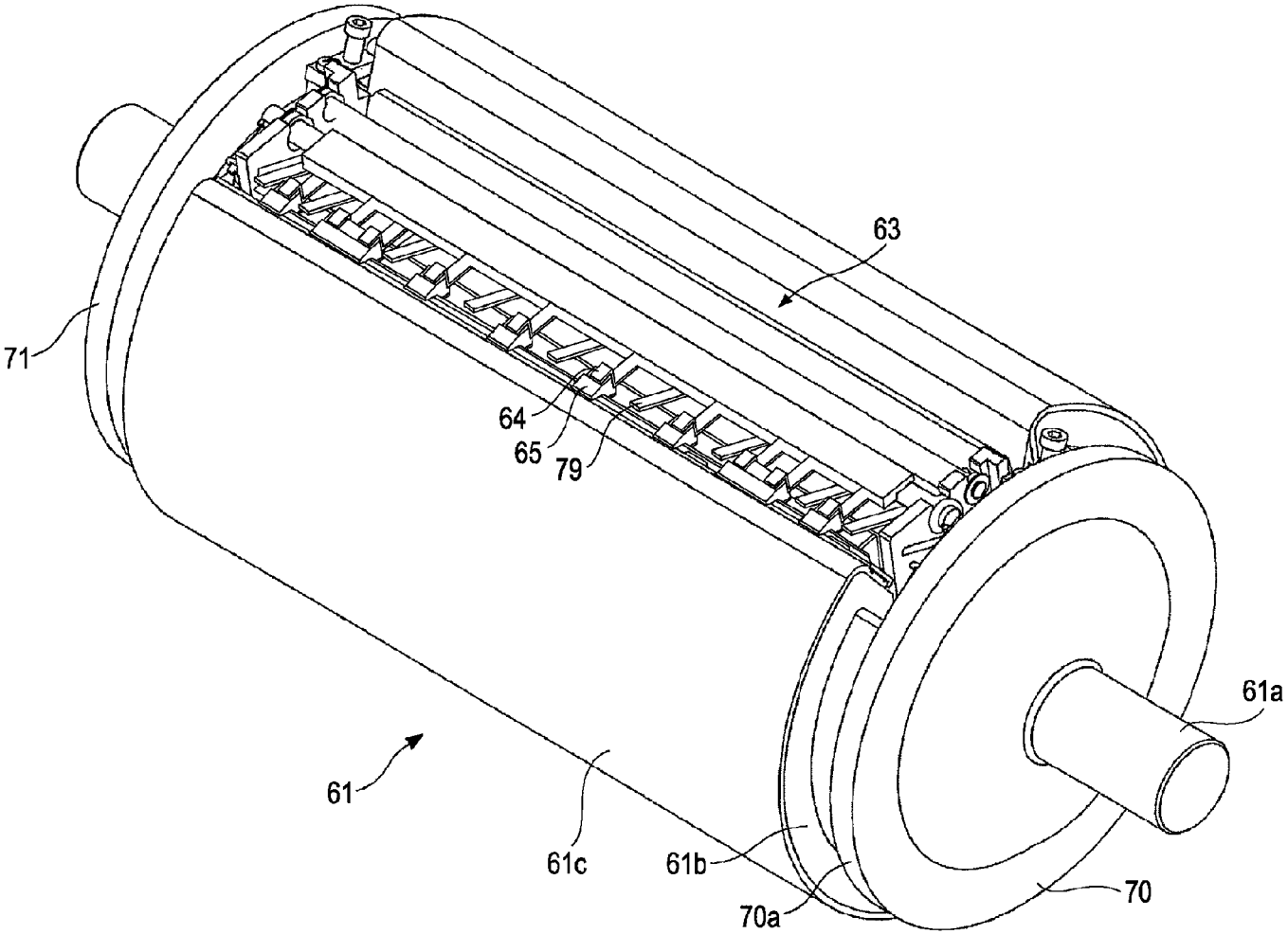
FIG. 2 is a perspective view of a secondary transfer roller used in the image forming apparatus in an embodiment of the invention.
Figure 3:
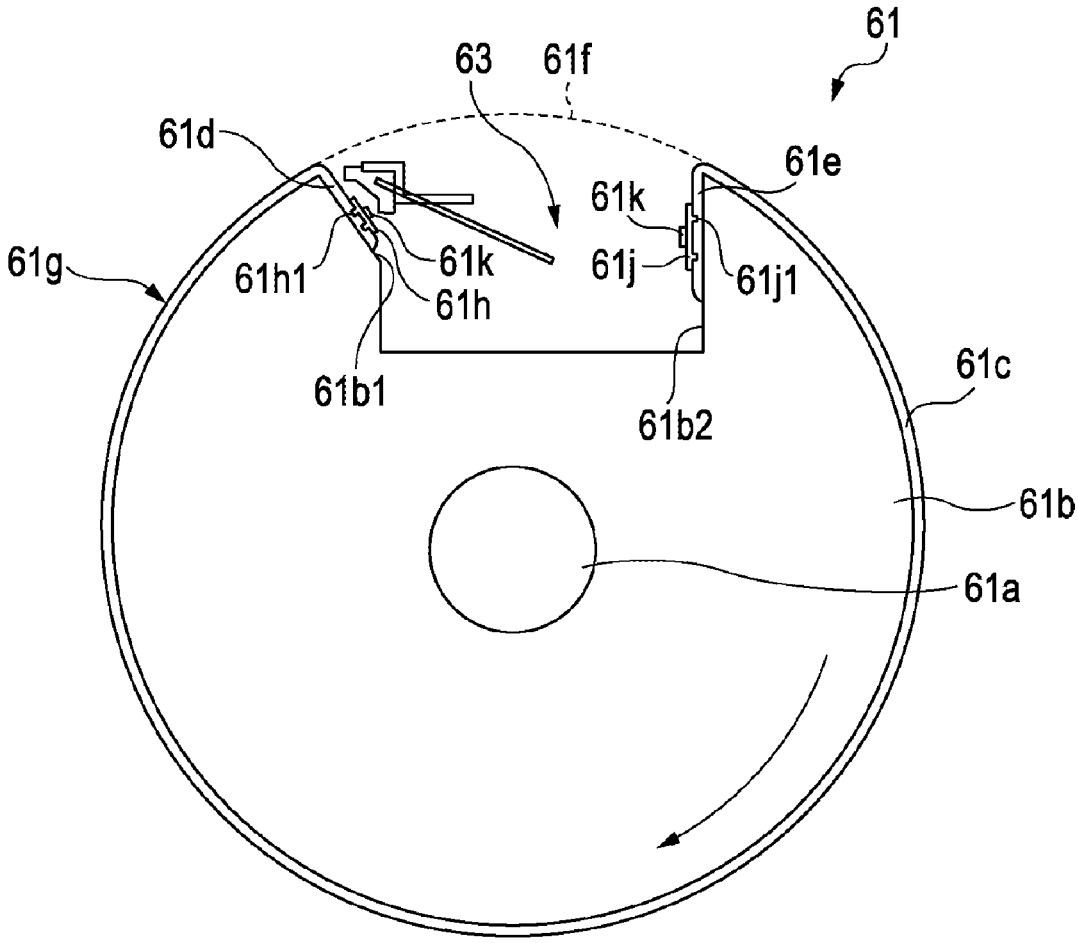
FIG. 3 is a cross-sectional view of the secondary transfer roller.

Next, a secondary transfer roller 61 used in the image forming apparatus relating to an embodiment of the invention will be described in detail. FIG. 2 is a perspective view of the secondary transfer roller 61 used in the image forming apparatus relating to the embodiment of the invention. FIG. 3 is a cross-sectional view and FIG. 4 is a partial cross-sectional view of the same.

The secondary transfer roller 61 includes a recessed portion 63 as a support member of transfer material grip members 64, grip member receiving portions 65 and detach members 79. As shown in FIG. 2, this recessed portion 63 is extendedly constructed in the axial direction of the secondary transfer roller 61. Additionally, the secondary transfer roller 61 has an elastic rubber sheet 61*c* wound around the perimeter surface of an arc which is a contact portion 61*g*, which comes in contact with the transfer belt 40, of a conductive base material 61*b*. This rubber sheet 61*c* forms a resistive layer on the contact portion 61*g* on the arc of the secondary transfer roller 61. The rubber sheet 61*c* is constructed of three layers: a base material layer, an elastic layer and a surface layer. The base material layer is approximately 80 to 90 μm thick and is made of polyimide resin, for example. The elastic layer is approximately 0.5 to 5 mm thick and made of urethane rubber, for example. The surface layer is approximately 5 to 25 μm thick and is made of fluoro-rubber, for example. The volume resistivity of the rubber sheet 61*c* is from $1\times10^{6}$ to $1\times10^{11}\Omega$.

As shown in FIG. 3, both ends 61*d* and 61*e* of this rubber sheet 61*c* are fixed to the wall surfaces 61*b*1 and 61*b*2 of a recessed portion formed in the base material 61*b* while the rest is merely wound around the base material 61*b* and is not glued or affixed to it. For example, it is preferable if there be plates 61*h*, 61*j* extended lengthwise in the rotational axial direction of a shaft 61*a* on top of the both ends 61*d* and 61*e* of the rubber sheet 61*c*, and that these plates be secured with screws 61*k* and the like into the base material 61*b*. Additionally, on the plates 61*h* and 61*j* there are ridges 61*h*1 and 61*j*1. The plates 61*h* and 61*j* are solidly secured by these ridges 61*j*1 and 61*h*1 that are pressed into the rubber sheet 61*c*. Alternate methods, not limited to the above, for securing the both ends 61*d* and 61*e* of the rubber sheet 61*c* into the recessed portion 63 can be used.

Figure 4:
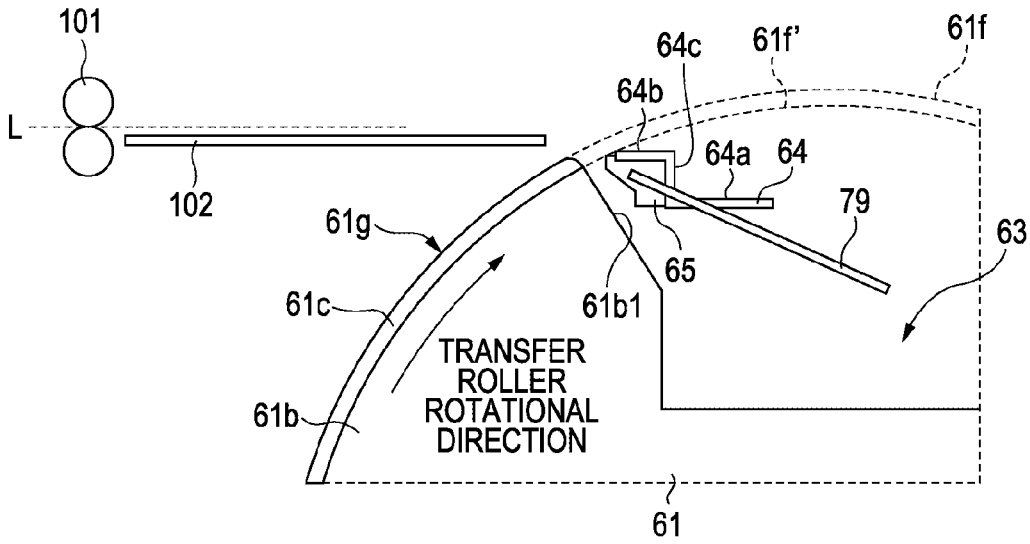
FIG. 4 is a cross-sectional view of a portion of the secondary transfer roller.

As shown in FIG. 4, near the wall surface 61*b*1 of the recessed portion 63 on the downstream side in the rotational direction of the transfer roller 61 there are the transfer material grip members 64 for gripping the transfer material, and the grip member receiving portions 65 from which the transfer material grip members 64 can lift off or return to rest. The transfer material grip members 64 are disposed along the axial direction of the secondary transfer roller 61 and there can be as many constructed as desired. Each of the transfer material grip members 64 is formed into thin metal strips to be of the same size and/or shape. One example of this is where the transfer material grip member 64 is bent into the shape of a crank handle. On one end of the transfer material grip member 64 is a fixing end portion 64*a* and the other end is a holding portion 64*b* that rests on or lifts off from the grip member receiving portion 65. The holding portion 64*b* pinches a leading edge Sa of a transfer material S between the holding portion 64*b* and the grip member receiving portion 65. Furthermore, the transfer material grip member 64 has a bending portion 64*c* between the fixing end portion 64*a* and the holding portion 64*b*.

The length of the circumference of the secondary transfer roller 61 is set to be longer than the length of the longest transfer material S in the transfer material moving direction among the transfer materials S that may be used in the image forming apparatus 1 in this example. More specifically, the length of the circumference of the contact portion 61*g* of the secondary transfer roller 61, excluding the width of the recessed portion 63 from the secondary transfer roller rotational direction, is set to be longer than the longest length of the aforementioned transfer material S in the transfer material moving direction. This enables the toner image from the transfer belt 40 to be securely transferred even to the transfer material S that has the longest length in the transfer material moving direction.

As shown in FIG. 2, included with the secondary transfer roller 61 are contact members 70 and 71 that rotate together. The contact members 70 and 71 have arc shaped circumference surfaces 70*a* and 71*a* that are concentric to the secondary transfer roller 61. The contact members 70 and 71 either directly or indirectly come in contact with the belt drive roller 41 when the recessed portion 63 of the secondary transfer roller 61 is at the position opposite the pressing nip portion with the belt drive roller 41.

As shown in FIG. 2, the grip member receiving portions 65 are arranged along the axial direction of the secondary transfer roller 61. There are the same number of grip member receiving portions 65 as there are the transfer material grip members 64. Additionally, there are detach members 79 disposed inside the recessed portion 63. As shown in FIG. 4, the detach members 79 are arranged along the axial direction of the secondary transfer roller 61. There can be as many detach members 79 formed as desired. Moreover, the grip member receiving portions 65 are arranged so that they are alternately placed between adjacent detach members 79. Each of the detach members 79 is formed into thin metal strips of the same size and shape. Although not shown in the drawing, the detach members 79 are connected at a connection portion and formed as pectinate teeth of one contiguous component.

As shown in FIG. 4, the transfer material grip members 64, the grip member receiving portions 65 and detach members 79 are supported close to the wall surface 61*b*1 which is downstream in the rotational direction of the transfer roller 61 inside the recessed portion 63 so that they are positioned within an imaginary circumference 61*f* of the contact portion 61*g* of the base material 61*b* which is wound with the rubber sheet 61*c* and the transfer belt 40.

Figure 5:
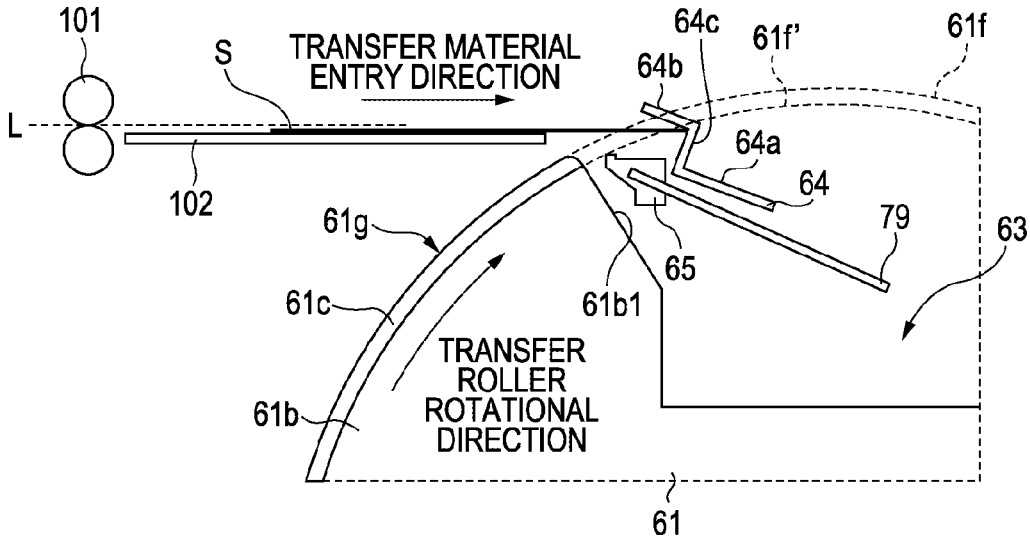
FIG. 5 is a cross-sectional view of a portion of the secondary transfer roller.

As shown in FIG. 5, by the rotation of the transfer roller 61, the transfer material grip members 64, which are set to open positions, come closer to a supply position of the transfer material S. Here, the tips of the holding portions 64*b* on the transfer material grip members 64 extend out of the imaginary circumference 61*f* of the contact portion 61*g* of the base material 61*b* which is wound with the rubber sheet 61*c* and the transfer belt 40. The rotations of the belt drive roller 41, the transfer roller 61 and the gate rollers 101 are synchronously controlled so that the toner image on the transfer belt 40 will be transferred onto the designated position on the transfer material S at the transfer nip portion. At this time, the circumferential speed of the transfer roller 61 (i.e. the travelling speed of the transfer material grip members 64) is set to be slower than the travelling speed of the transfer material S. The leading edge of the transfer material S enters between the transfer material grip members 64 and the grip member receiving portions 65 and contacts with the bending portions 64*c* of the transfer material grip members 64. As a result, due to the difference in speeds between the circumferential speed of the secondary transfer roller 61 and the travelling speed of the transfer material S, the leading edge of the transfer material S contacts with the boundary of the holding portions 64*b* and the bending portions 64*c*, which serves to align the transfer material in relation to the transfer material grip members 64, and also causes the leading edge Sa of the transfer material S to sag. The timing for the leading edge of the transfer material S making contact with the boundary of the holding portions 64*b* which is a position determining portion and the bending portions 64*c* is at the time when the wall surface 61*b*2 of the recessed portion 63 on the upstream side in the rotational direction of the secondary transfer roller 61 reaches the nip portion with the transfer belt 40 and further rotates so that the recessed portion 63 is at the position corresponding to the nip portion.

Figure 6:
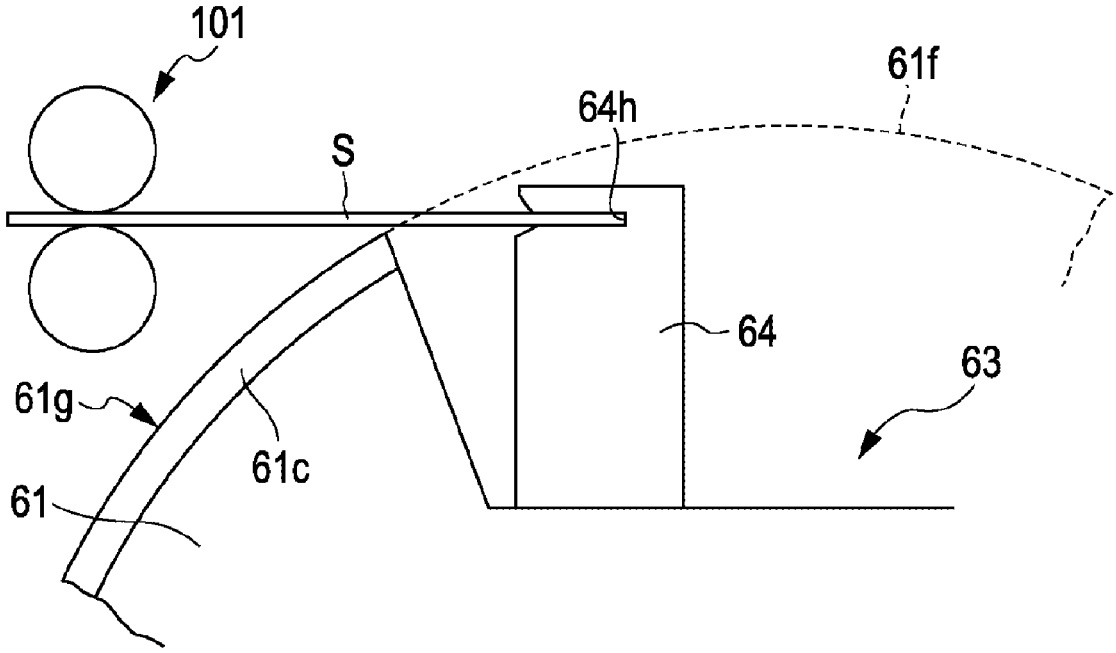
FIG. 6 is a cross-sectional view of a portion of the secondary transfer roller.

FIG. 6 is a view illustrating an alternate embodiment of the transfer material grip members 64. The transfer material grip members 64 in this embodiment are supported by the recessed portion 63. A groove 64*h* of approximately the same thickness as the transfer material S is formed in the transfer material grip members 64. The groove 64*h* grips the transfer material S, and the strike section of the groove 64*h* is set as a position determining portion. The transfer material grip members 64 are inside the imaginary circumference 61*f* of the contact portion 61*g* of the base material 61*b* which is wound with the rubber sheet 61*c* and the transfer belt 40.

However, if during the feed process which is from the gate rollers 101 to the boundary between the holding portions 64*b* which is the position determining portion and the bending portions 64*c*, the transfer material S contacts the contact portion 61*g* which is wound with the rubber sheet 61*c* of the secondary transfer roller 61, then the travelling speed of the transfer material is disrupted, and even if the rotations of the belt drive roller 41, the transfer roller 61 and the gate rollers 101 are synchronously controlled, this causes the transfer material S to be imprecisely positioned, resulting in the problem of the toner image not being transferred to the correct position on the transfer material S.

In order to prevent this, the transfer material feed guide 102 is disposed between the gate rollers 101 and the nip portion of the transfer roller 61 and the transfer belt 40. The distance between the exit portion of the transfer material feed guide 102 and the nip portion between the transfer roller 61 and the transfer belt 40 is made as close as possible. However, if the distance between the gate rollers 101 and the nip portion between the transfer roller 61 and the transfer belt 40 is very short, there is no need for the transfer material feed guide 102.

The transfer material grip members 64, the grip member receiving portions 65 and the detach members 79 supported by the recessed portion 63 are preferably be disposed as closely as possible to the wall surface 61*b*1 of the recessed portion 63 on the downstream side in the rotational direction of the transfer roller 61. For this reason, there is a risk that the boundary portion between the contact portion 61*g* and the wall surface 61*b*1 is overlapped on a straight line connected between the boundary of the holding portion 64*b* which is the position determining portion of a grip member and the bending portion 64*c* and the exit portion of the transfer material feed guide 102.

Figure 7:
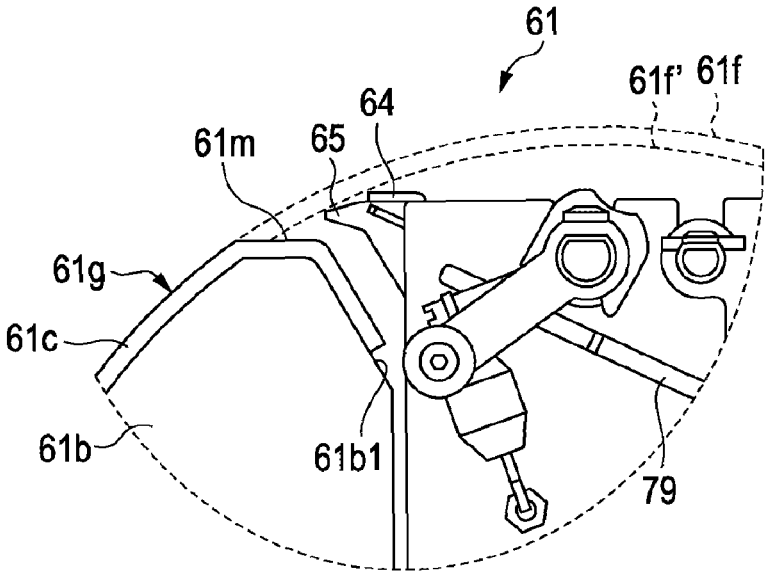
FIG. 7 is a cross-sectional view of a portion of the secondary transfer roller.

FIG. 7 illustrates an embodiment in which the boundary portion between the contact portion 61*g* and the wall surface 61*b*1 is prevented from being overlapped on a straight line connected between the boundary of the holding portion 64*b* which is the position determining portion of the grip member and the bending portion 64*c* and the exit portion of the transfer material feed guide 102. As shown in FIG. 7, a flat cutout portion 61*m* is formed at the boundary portion of the contact portion 61*g* and the wall surface 61*b*1. Forming the flat cutout portion 61*m* at the boundary portion allows the contact portion 61*g* which is wound with the elastic member 61*c* not to exist on the straight line which is connected between the exit portion of the transfer material feed guide 102 and the boundary of the holding portion 64*b* which is the position determining portion and the bending portion 64*c*, and thus the transfer material is prevented from being contacted with the contact portion 61*g* which is wound with the elastic member 61*c* during the feed process which is from the gate rollers 101 to the boundary between the holding portion 64*b* which is the position determining portion and the bending portion 64*c*, and accordingly, allows to accurately determine the position of the transfer material.

Figure 8:
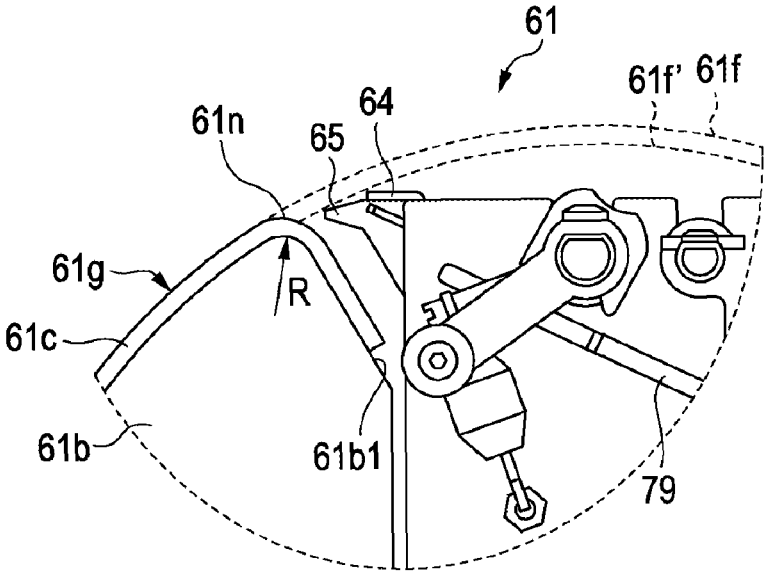
FIG. 8 is a cross-sectional view of a portion of the secondary transfer roller.

FIG. 8 is a diagram of an alternative embodiment in which the boundary portion between the contact portion 61*g* and the wall surface 61*b*1 is prevented from being overlapped on the straight line connected between the boundary of the holding portion 64*b* which is the position determining portion of the transfer material grip members 64 and the bending portion 64*c* and the exit portion of the transfer material feed guide 102. As shown in FIG. 8, a rounded portion 61*n* is formed at the boundary portion of the wall surface 61*b*1 and the contact portion 61*g*. Forming the rounded portion 61*n* at the boundary portion allows the contact portion 61*g* which is wound with the elastic member 61*c* not to exist on the straight line which is connected between the exit portion of the transfer material feed guide 102 and the boundary of the holding portion 64*b* which is the position determining portion and the bending portion 64*c*, and thus the transfer material is prevented from being contacted with the contact portion 61*g* which is wound with the elastic member 61*c* during the feed process which is from the gate rollers 101 to the boundary between the holding portion 64*b* which is the position determining portion and the bending portion 64*c*, and accordingly, allows to accurately determine the position of the transfer material S.

Figure 9:
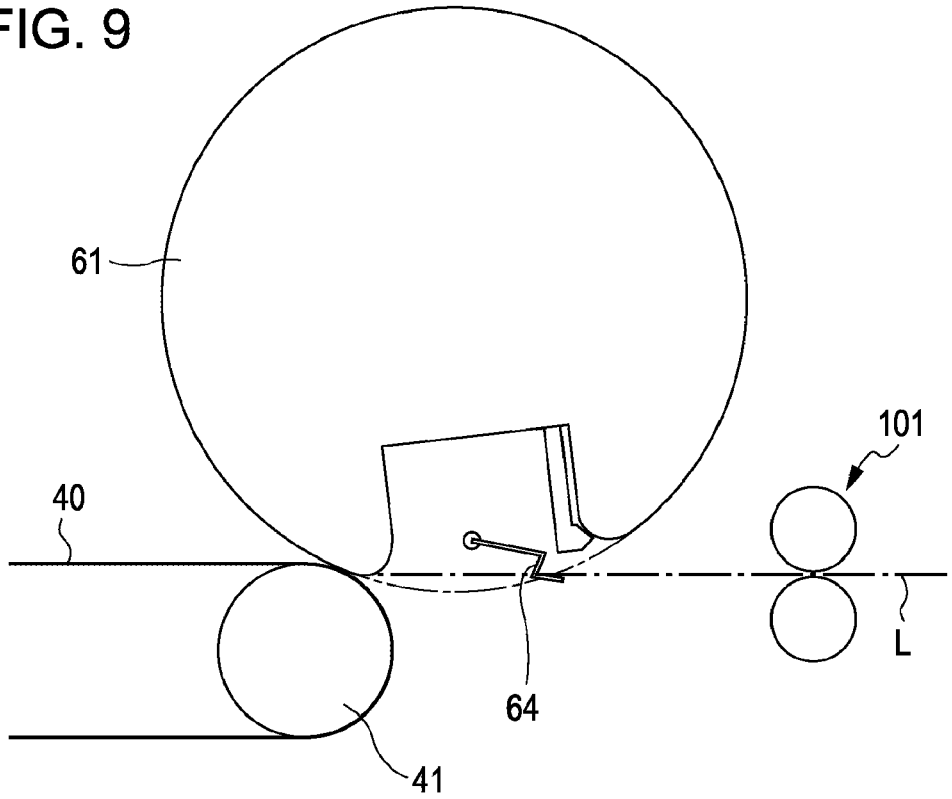
FIG. 9 is a cross-sectional view of a portion of the secondary transfer roller.

FIG. 9 illustrates a state in which the contact portion 61*g* of the transfer roller 61 does not exist on a transfer material feed line L which is connected between the exit portion of the gate rollers 101 and the boundary of the holding portion 64*b* which is the position determining portion of the transfer material grip members 64 and the bending portion 64*c*. The transfer material S is prevented from being contacted with the contact portion 61*g* which is wound with the elastic member 61*c* during the feed process which is from the gate rollers 101 to the boundary between the holding portion 64*b* which is the position determining portion and the holding portion 64*c*, and accordingly allows to accurately determine the position of the transfer material S.

Figure 10:
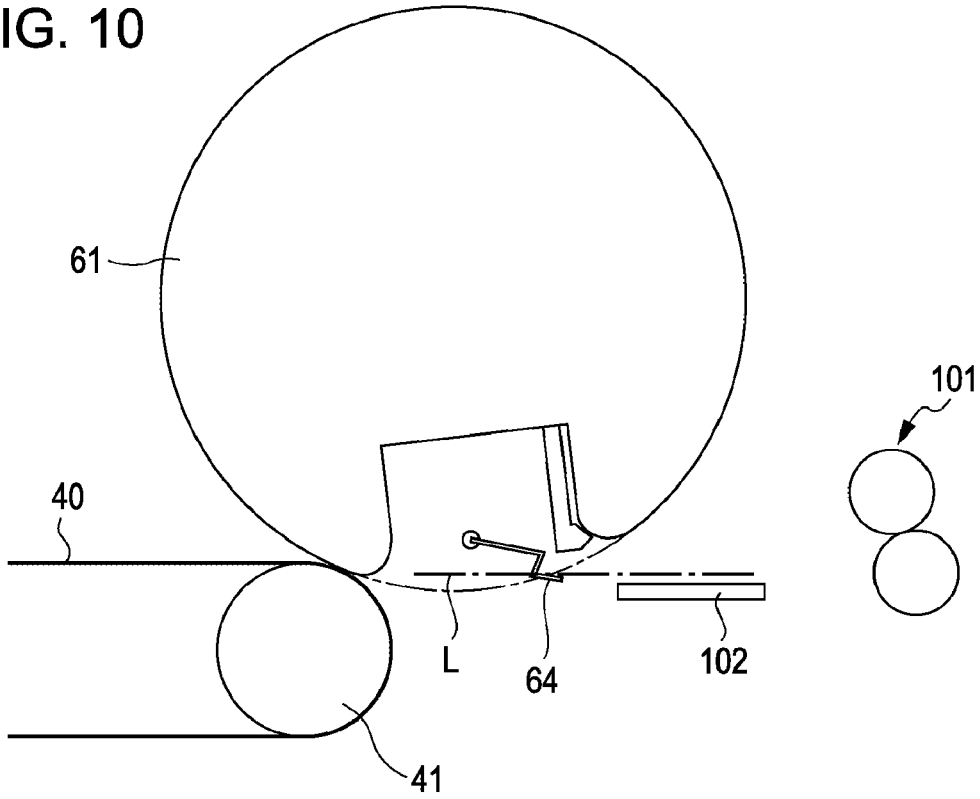
FIG. 10 is a cross-sectional view of a portion of the secondary transfer roller.

FIG. 10 illustrates a state in which the contact portion 61*g* of the transfer roller 61 does not exist on the transfer material feed line L which is connected between the exit portion of the transfer material feed guide 102 and the boundary of the holding portion 64*b* which is the position determining portion of the transfer material grip members 64 and the bending portion 64*c*. The transfer material S is prevented from being contacted with the contact portion 61*g* which is wound with the elastic member 61*c* during the feed process which is from the transfer material feed guide 102 to the boundary between the holding portion 64*b* which is the position determining portion and the holding portion 64*c*, and accordingly allows to accurately determine the position of the transfer material S.

The transfer of the toner image onto the transfer material S at the secondary transfer unit 60 will be described with reference to FIG. 11 through FIG. 14.

Figure 11:
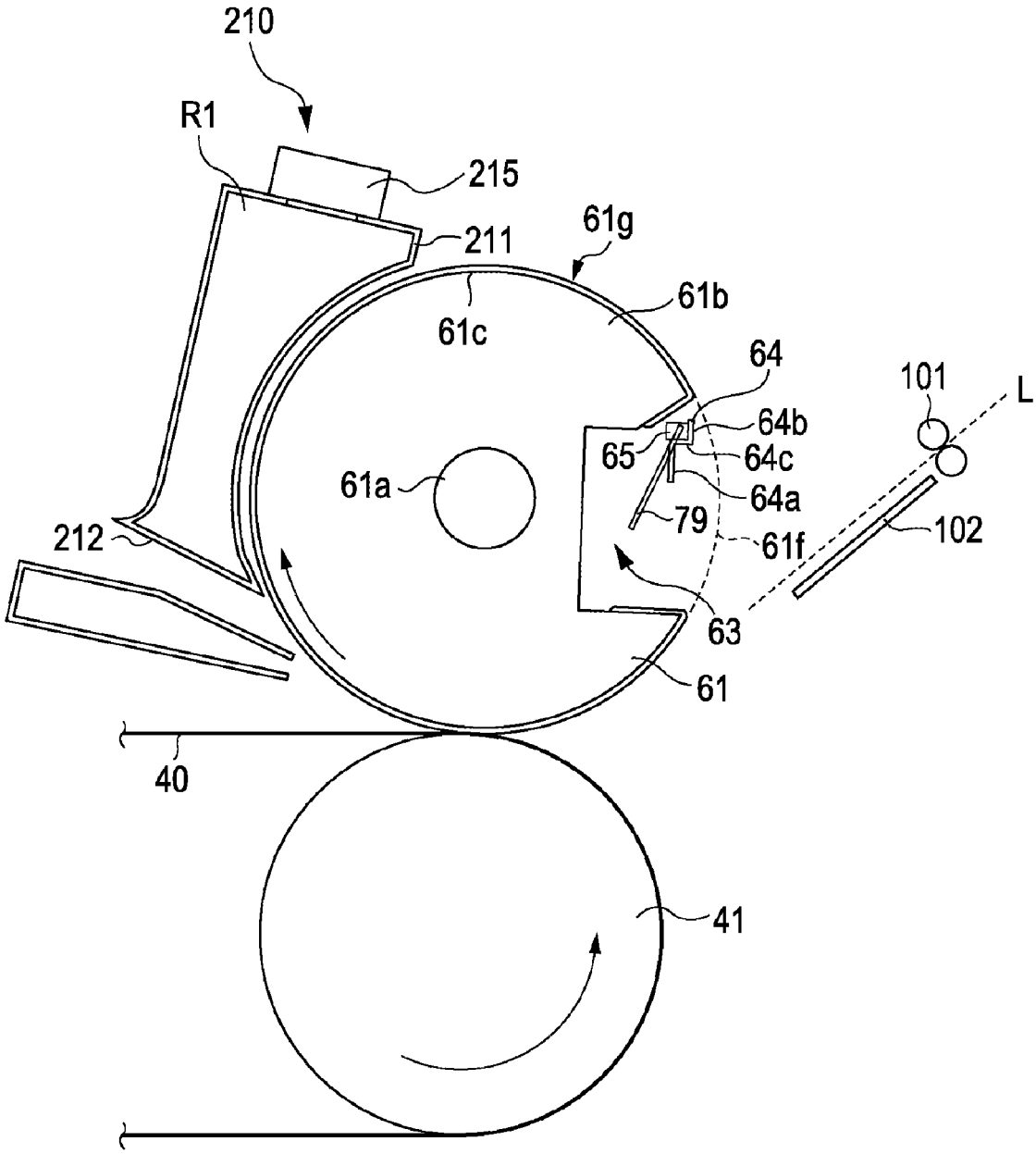
FIG. 11 is a diagram showing the operation of the transfer material grip members and the detach members.

When the belt drive roller 41 causes the transfer belt 40 to start to rotate, the transfer roller 61 also starts to rotate. As shown in FIG. 11, the holding portion 64*b* of the transfer material grip member 64 is resting on the grip member receiving portion 65. Also, the detach member 79 is set to be at a refuge position. In this state, the transfer material grip member 64, the grip member receiving portion 65 and the releasing member 79 are inside the imaginary circumference 61*f* of the contact portion 61*g* of the base material 61*b* which is wound with the rubber sheet 61*c* and the transfer belt 40.

As the toner image carried by the transfer belt 40 comes closer to the secondary transfer unit 60, each of the transfer material grip members 64 starts to lift off from the grip member receiving portions 65.

Figure 12:
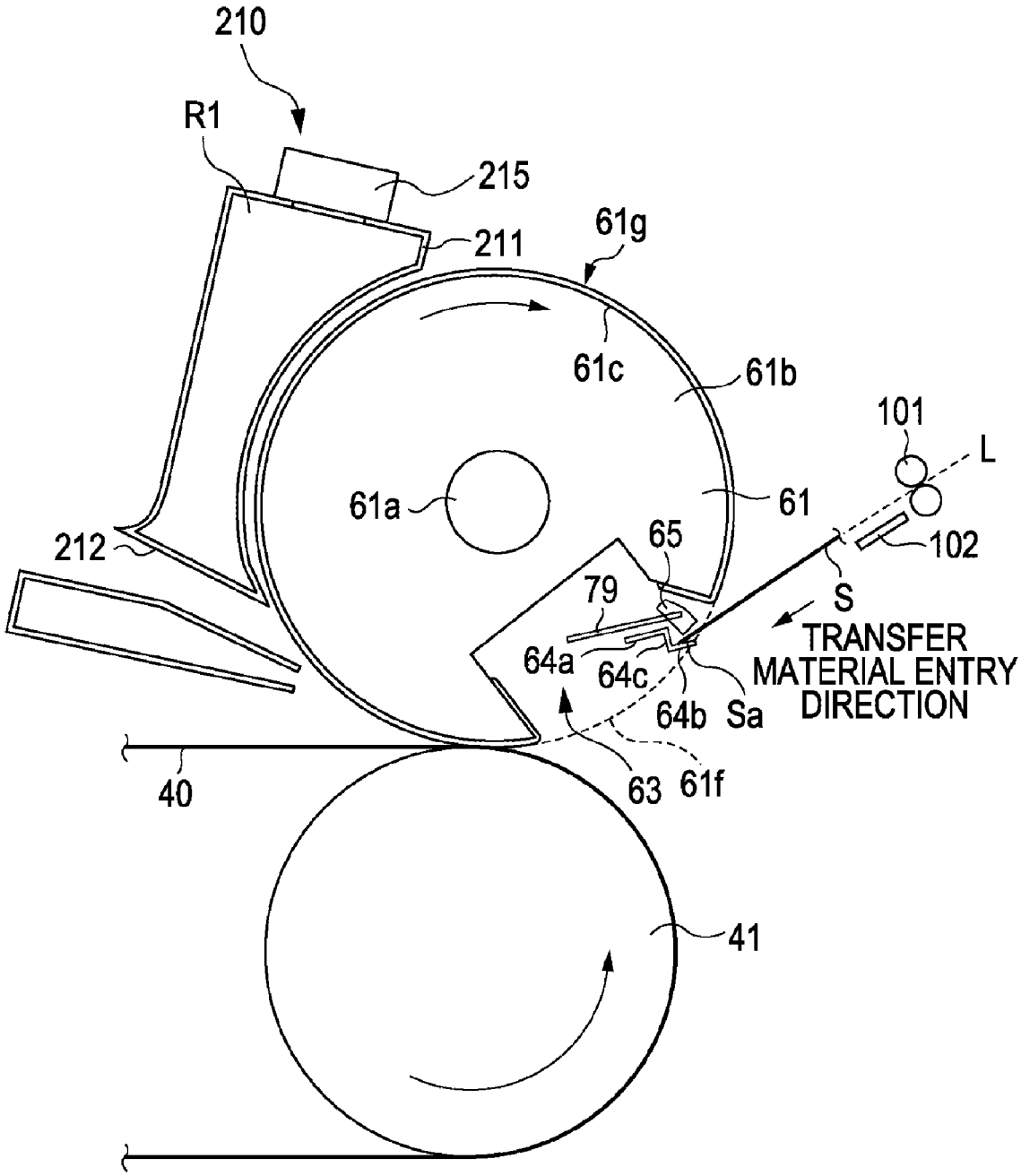
FIG. 12 is a diagram showing the operation of the transfer material grip members and the detach members.

As shown in FIG. 12, the rotation of the transfer roller 61 causes the transfer material grip members 64 which are set to an open position to come closer to the supply position of the transfer material S. At this time, the tips of the holding portions 64*b* of the transfer material grip members 64 are extend our of the imaginary circumference 61*f* of the contact portion 61*g* of the base material 61 which is wound with the rubber sheet 61*c* and the transfer belt 40, However, because they have not reached the contact position with the transfer belt 40, the holding portions 64*b* do not contact the transfer belt 40. On the other hand, simultaneous to the transfer material S being supplied toward the transfer roller 61, the toner image carried on the transfer belt 40 comes closer to the secondary transfer unit 60. The rotations of the belt drive roller 41, the secondary transfer roller 61 and the gate rollers 101 are synchronously controlled to enable the toner image carried on the transfer belt 40 to be transferred to the designated position on the transfer material S at the transfer nip portion. Here, the circumferential speed of the transfer roller 61 (i.e. the travelling speed of the transfer material grip members 64) is set to be slower than the travelling speed of the transfer material S.

The leading edge of the transfer material S enters between the transfer material grip members 64 and the grip member receiving portions 65 and contacts the boundary of the holding member 64*b* which is the position determining portion of the transfer material grip members 64 and the bending portion 64*c*. As a result, due to the difference in speeds between the circumferential speed of the transfer roller 61 and the travelling speed of the transfer material S, the leading edge of the transfer material S contacts with the boundary of the holding portions 64*b* which is the position determining portion and the bending portions 64*c*, which serves to align the transfer material in relation to the transfer material grip members 64, and also causes the leading edge Sa of the transfer material S to sag. The timing for the leading edge of the transfer material S making contact with the boundary of the holding portions 64*b* which is the position determining portion and the bending portions 64*c* is at the time when the wall surface 61*b*2 of the recessed portion 63 on the upstream side in the rotational direction of the transfer roller 61 reaches the nip portion with the transfer belt 40. The transfer material S is prevented from being contacted with the contact portion 61*g* which is wound with the rubber sheet 61*c* during the feed process which is from the gate rollers 101 to the boundary between the holding portion 64*b* which is the position determining portion and the holding portion 64*c*, and accordingly prevents the supply speed of the transfer material S from being disrupted and allows to accurately determine the position of the transfer material S.

Figure 13:
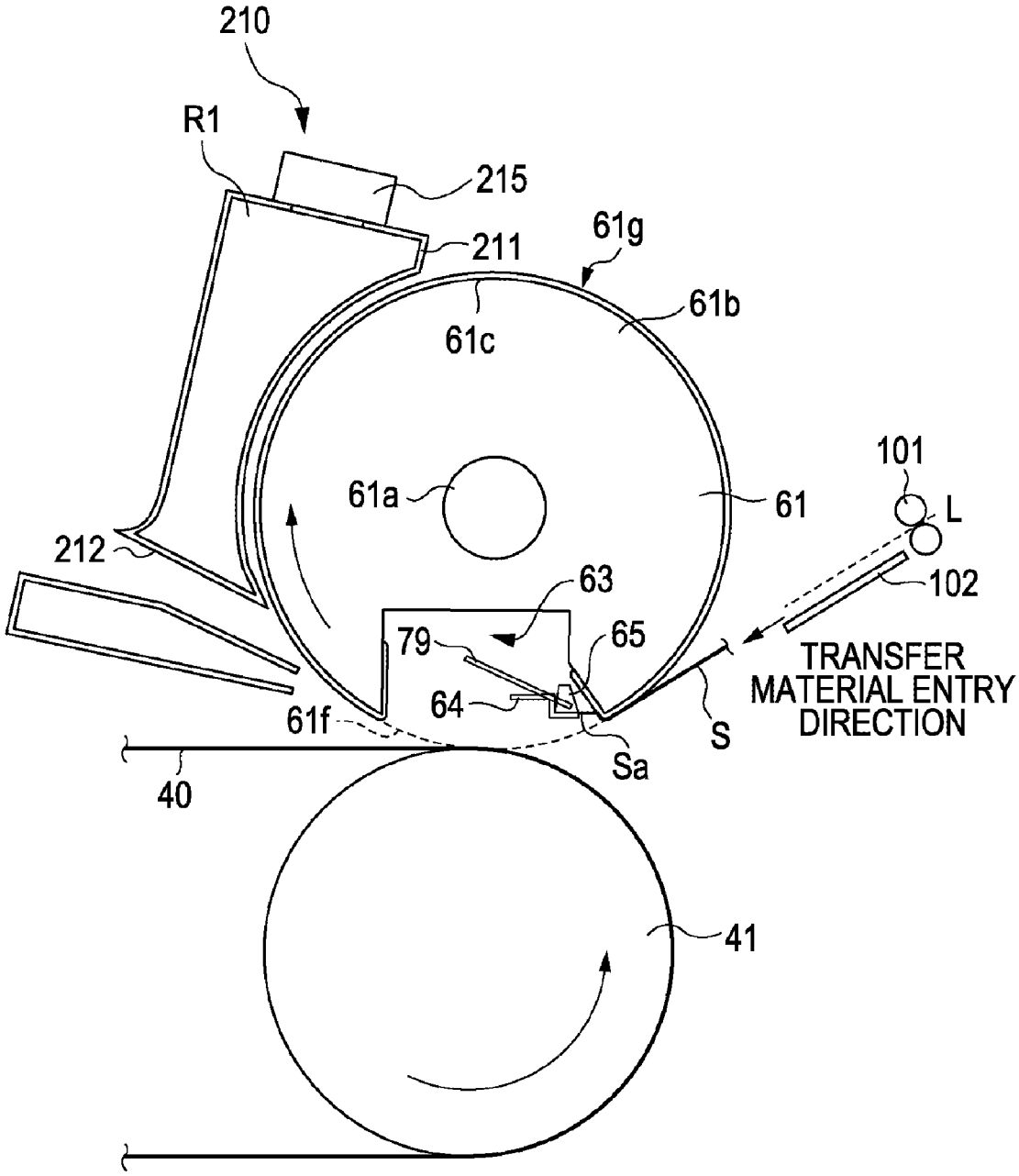
FIG. 13 is a diagram showing the operation of the transfer material grip members and the detach members.

Then, a portion of the transfer material S contacts the perimeter surface of the transfer roller 61, and bends along the perimeter surface. Each of the transfer material grip members 64 will start to come closer to the grip member receiving portions 65. As shown in FIG. 13, each of the transfer material grip members 64 presses the leading edge Sa of the transfer material S against the grip member receiving portions 65 and holds it there. In this state, the holding portions 64*b* are inside the imaginary circumference 61*f* of the contact portion 61*g* of the base material 61 which is wound with the rubber sheet 61C and the transfer belt 40, so the holding portions 64*b* will not contact the transfer belt 40. Thus, the transfer material S is positioned in relative to the transfer roller 61, and with the rotation of the secondary transfer roller 61 the transfer material S accurately moves toward the transfer nip portion. At this time, the detach members 79 are held in a refuge position.

Figure 14:
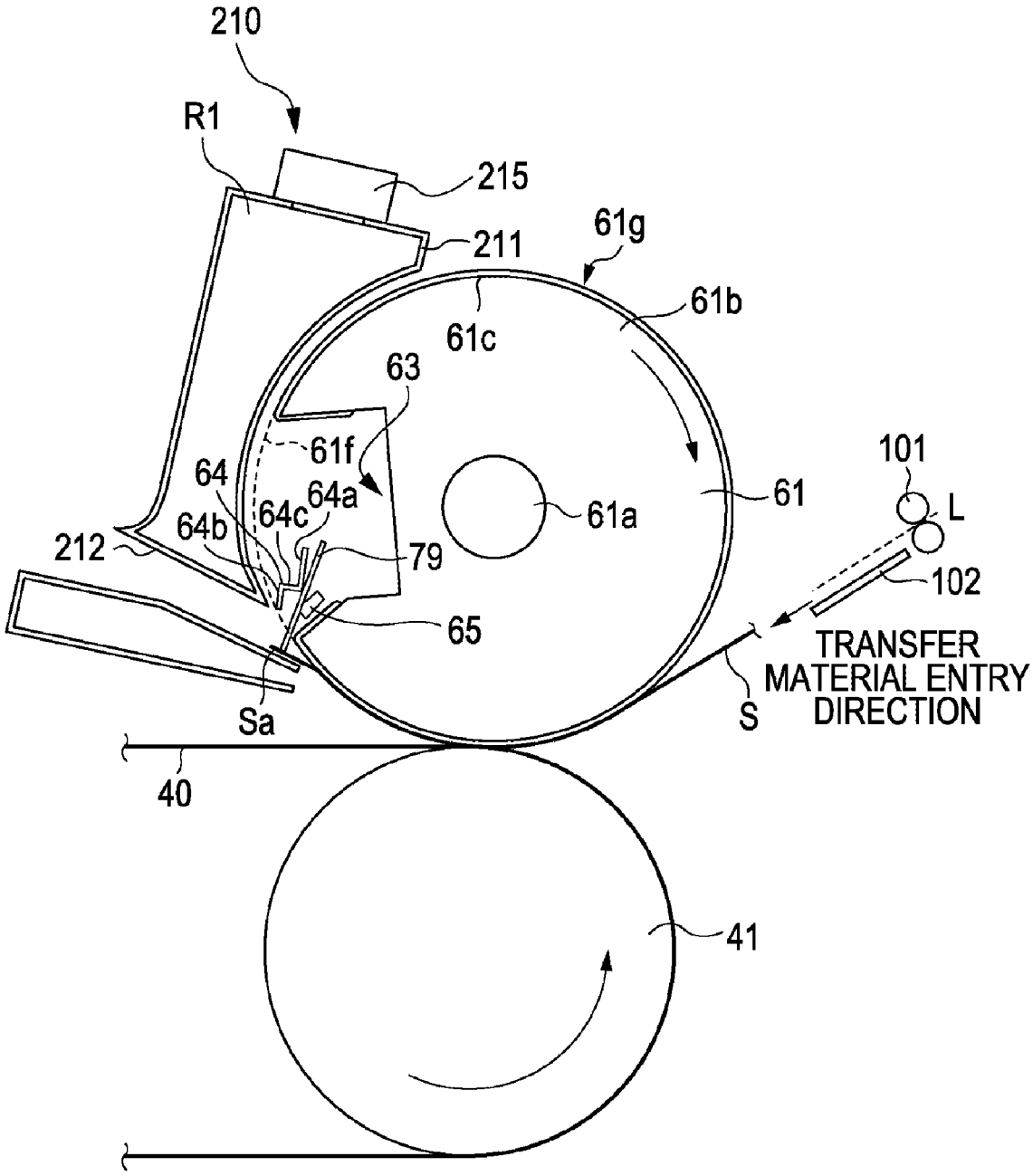
FIG. 14 is a diagram showing the operation of the transfer material grip members and the detach members.

The toner image on the transfer belt 40 is transferred onto the transfer material S at the transfer nip portion. After the holding portions 64*b* of the transfer material grip members 64 and the leading edge Sa of the transfer material S pass through the transfer nip portion, as shown in FIG. 14, the transfer material grip members 64 start to move away from the grip member receiving portions 65, and the leading edge Sa of the transfer material S is released. Next, with additional rotation of the transfer roller 61, the detach members 79 move to the protrusion position. In this state, the transfer material grip members 64 and the tips of the detach members 79 are in a position where they are extending out of the imaginary circumference 61*f* of the contact portion 61*g* of the base material 61 which is wound with the rubber sheet 61*c* and the transfer belt 40. However, because they are past the contact position with the transfer belt 40, the transfer material grip members 64 and the tips of the detach members 79 do not contact the transfer belt 40.

Meanwhile, the leading edge Sa of the transfer material S that has been released from the transfer material grip members 64 is lightly pressed toward the transfer roller 61 by the air being blown from a blower unit 400, which will be described later, while also being pressed in the direction away from the contact portion 61*g* of the transfer roller 61 by the detach members 79. In this manner, the leading edge Sa of the transfer material S is guided toward the transfer material feed system. The transfer material S pinched at the nip portion between the belt drive roller 41 and the secondary transfer roller 61 will move toward the transfer material feed system with additional rotation of the belt drive roller 41 and the transfer roller 61. In other words, while the toner image on the transfer belt 40 is being transferred to the transfer material S during the secondary transfer process, during which the release of transferred portion of the transfer material S is performed (the transfer releasing process). For the transfer materials S that have poor resilience and elastic restoration properties, the air being blown from the blower unit 400 can be omitted.

During the secondary transfer process onto the transfer material S illustrated in the FIG. 11 through FIG. 14, the transfer material grip members 64, the grip member receiving portions 65 and the detach members 79 are supported by the recessed portion 63 so as not to contact the transfer belt 40. The transfer material grip members 64, the grip member receiving portions 65 and the detach members 79 do not contact the transfer belt 40 during the secondary transfer process. Accordingly, this configuration enables to prevent any damage to the transfer belt 40 caused by the contact thereof, the disruption in the rotation and the fluctuations in pressure of the secondary transfer roller 61, and the occurrence of banding. Additionally, because the transfer material S does not contact the contact portion 61*g* which is wound with the rubber sheet 61*c* from the gate rollers 101 to the contact with the boundary of the holding portion 64 which is the position determining portion and the bending portion 64*c*, the supply speed of the transfer material S is not disrupted, allowing to accurately determine the position of the transfer material S.

The positioning of the transfer material S by the transfer material grip members 64 and the gripped state of the transfer material S will be described with reference to FIGS. 15A to 15C.

Figure 15A:
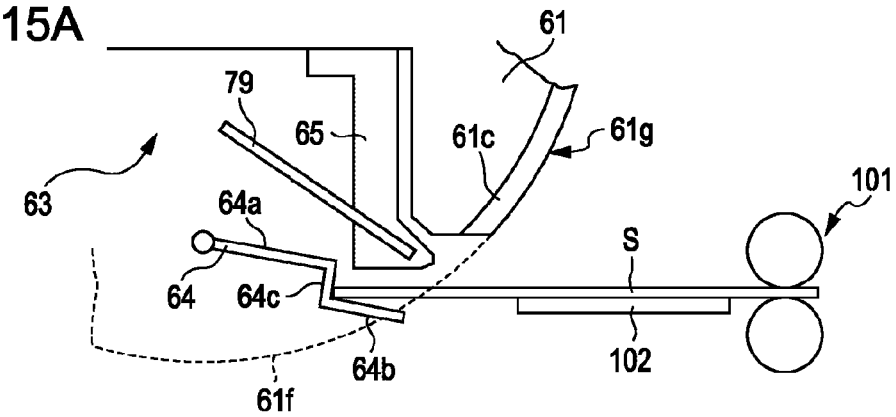
FIGS. 15A to 15C are diagrams showing the holding operation of the transfer material of the transfer material grip members.

As shown in FIG. 15A, the leading edge of the transfer material S enters between the transfer material grip member 64 and the grip member receiving portion 65 and contacts the boundary of the holding portion 64*b* which is the position determining portion and the bending portion 64*c*, without contacting the contact portion 61*g* on the transfer roller 61.

Figure 15B:
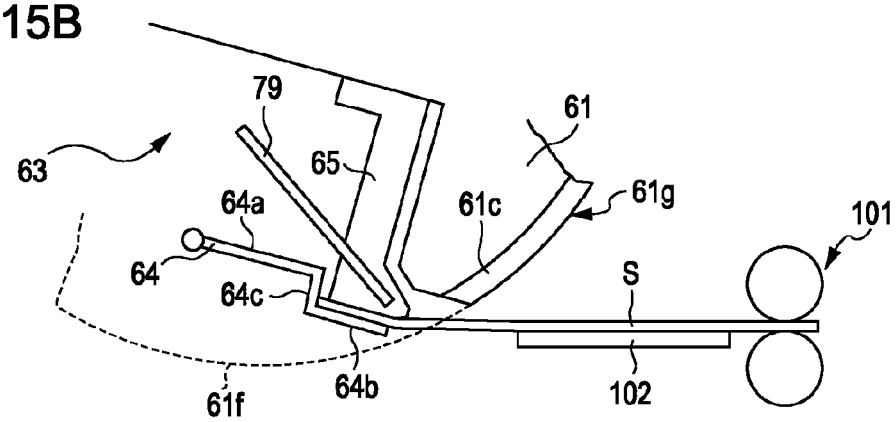

As shown in FIG. 15B, the holding portion 64*b* of the transfer material grip member 64 moves to the position to pinch the transfer material S in-between with the grip member receiving portion 65 through the transfer material S. In this state, the transfer material S does not contact the contact portion 61*g* provided with the rubber sheet 61*c* of the transfer roller 61. This configuration allows the hold of the transfer material S by the transfer material grip member 64 not to be affected by friction that may occur if the transfer material S contacts the contact portion 61*g*, enabling the transfer material S to be securely held.

Figure 15C:
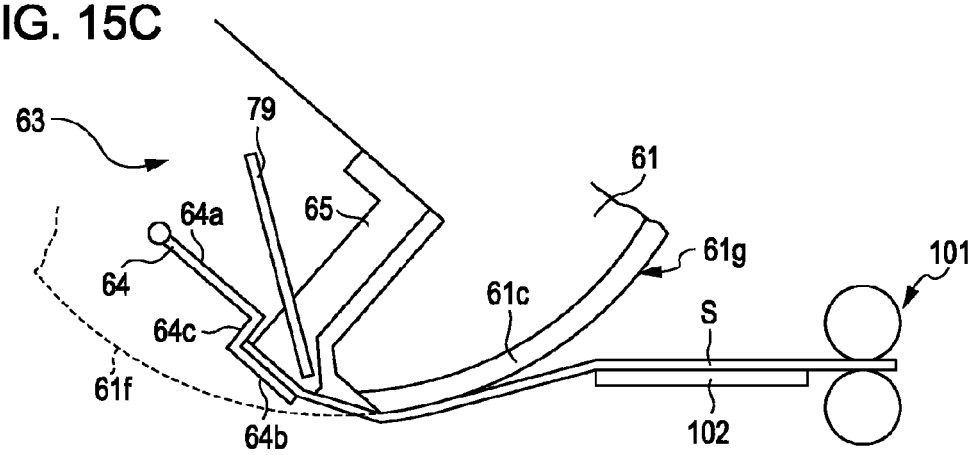

As shown in FIG. 15C, the transfer material grip member 64 moves while holding the leading edge of the transfer material S by pressing it against the grip member receiving portion 65, and the transfer material S is wound around the contact portion 61*g* of the transfer roller 61.

Figure 16:
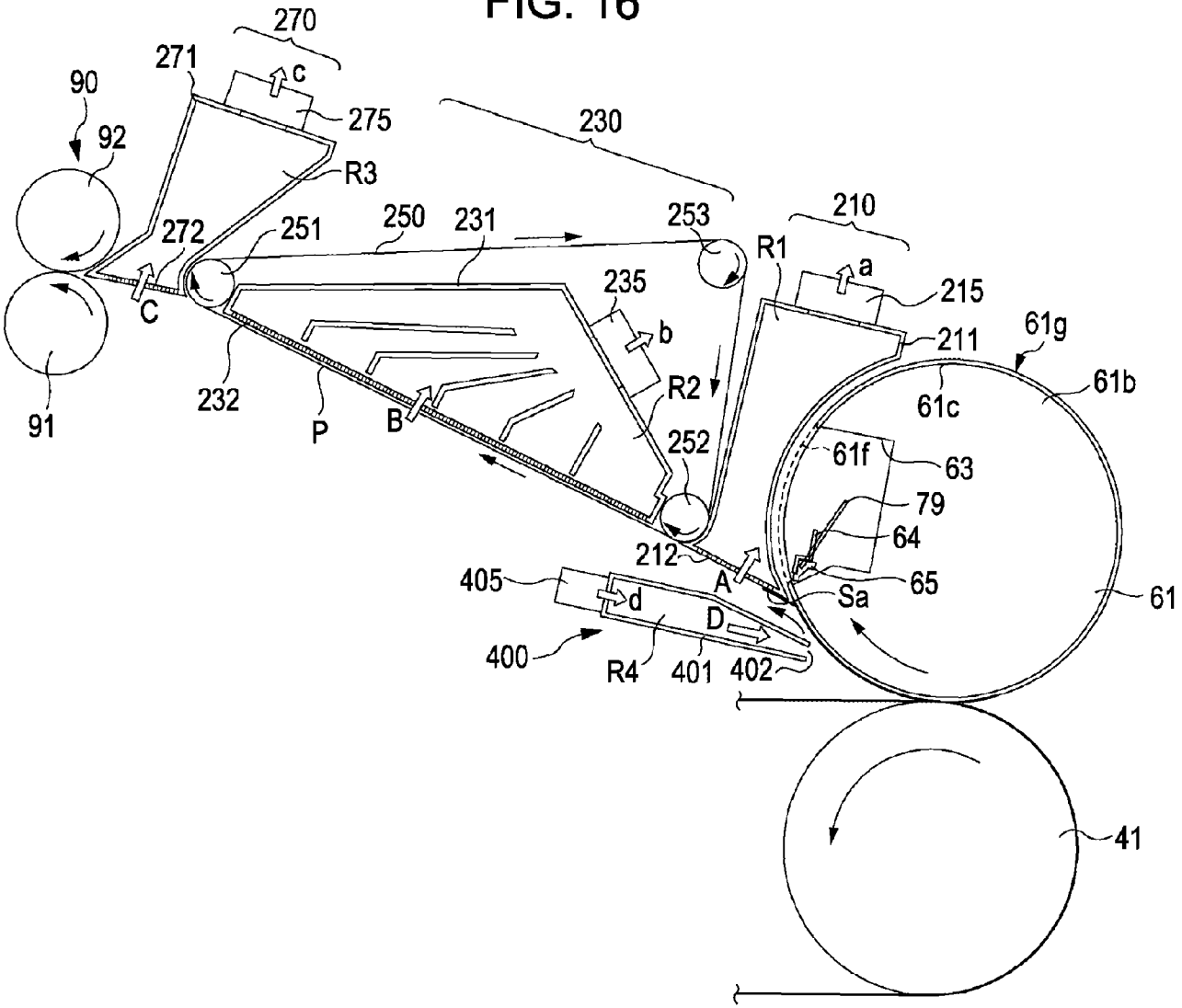
FIG. 16 is a diagram illustrating a transfer material feed system.

Next, the transfer material S is transported to the fixing unit 90. The feed system that executes this feed will be described here. FIG. 16 is a diagram of the transfer material feed system used in the image forming apparatus of an embodiment of an aspect of the invention. In FIG. 16, the transfer material feed system includes a first suction unit 210, a housing 211, a suction surface 212, an airflow generator 215, a transfer material feed unit 230, a housing 231, a suction surface 232, partitions 233, an airflow generator 235, a transfer material feed member 250, a transfer material feed drive roller 251, transfer material feed stretching rollers 252 and 253, a second suction unit 270, a housing 271, a suction surface 272, an airflow generator 275, a blower unit 400, a housing 401, a mouth 402, and an airflow generator 405.

The distance between the secondary transfer roller 61 and the edge of the suction surface 212 that holds the transfer material S of the first suction unit 210 which is the first guide portion preferably be as close as possible in order to prevent the transfer material S, released by the detach members 79, from being wound around the secondary transfer roller 61. However, the transfer material grip members 64 and the detach members 79 supported in a recessed portion 63 of the secondary transfer roller 61 are in a position where they extend out of the imaginary circumference 61*f* of the contact portion 61*g* of the base material 61 which is wound with the rubber sheet 61*c* and the transfer belt 40 during the release operation of the transfer material S. For this reason, between the secondary transfer roller 61 and the edge of the suction surface 212 of the first suction unit 210, a space is needed that prevents interference from a transfer material grip portion 64 and a transfer material detach member 79.

Figure 17A:
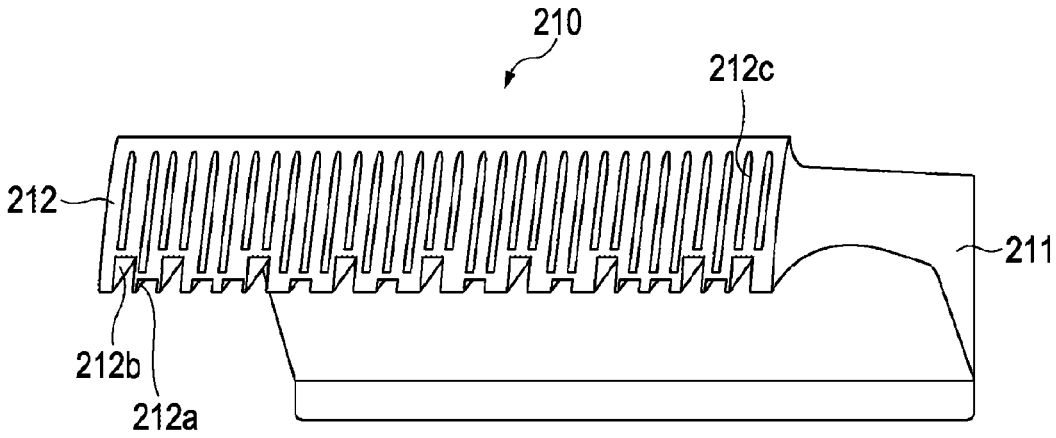
FIGS. 17A and 17B are diagrams illustrating a guide unit.
Figure 17B:
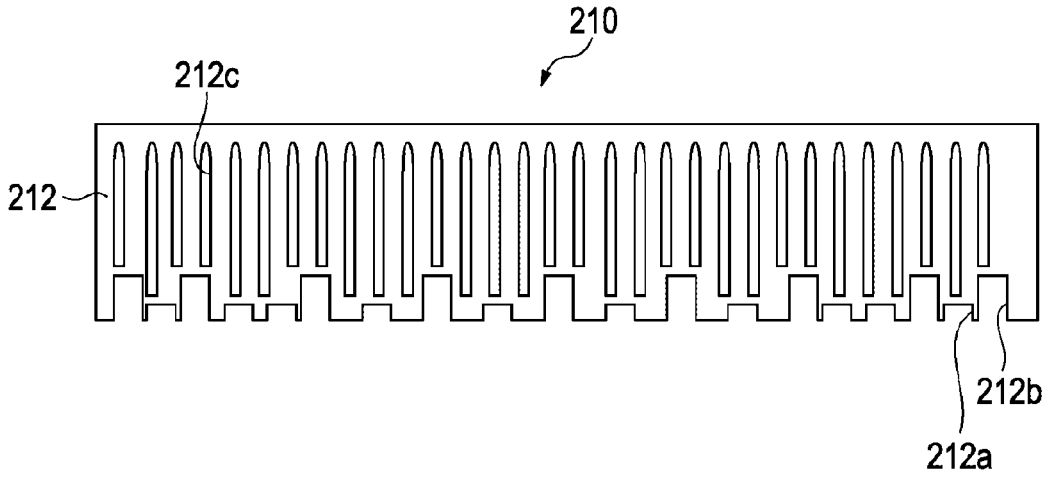

FIGS. 17A and 17B are diagrams of an embodiment of the first suction unit 210 in which the edge of the suction surface 212 of the first suction unit 210 is made as close as possible to the secondary transfer roller 61, preventing the interference from the transfer material grip members 64 and the detach members 79.

As shown in FIG. 17A, on the edge of the suction surface 212 of the first suction unit 210, which is adjacent to the secondary transfer roller 61, are grip member refuge passes 212*a* and detach member refuge passes 212*b* formed pectinately in a configuration corresponding to the locations of the transfer material grip members 64 and the detach members 79 of the secondary transfer roller 61. Forming pectinately the grip member refuge passes 212*a* and the detach member refuge passes 212*b* on the edge of the suction surface 212 enables the space between the secondary transfer roller 61 and the edge of the suction surface 212 to be narrowed, preventing the transfer material S that has been released by the detach member 640 from being wound around the secondary transfer roller 61.

Air ducts 212*c* are also formed in the pectinate grip member refuge passes 212*a* and the detach member refuge passes 212*b*. The suction force of the airflow generator 215 of the first suction unit 210 which is the first guide portion also acts on the pectinate grip member refuge passes 212*a* and the detach member refuge passes 212*b* through the air ducts 212*c*. As a result, after the transfer material S has passed the secondary transfer nip portion and been released from the transfer material grip members 64 and released by the detach members 79, the transfer material S is held by the suction surface 212 resisting the gravitational force without being wound around the secondary transfer roller 61.

The first suction unit 210 includes the housing 211 mounted of the airflow generator 215 such as sirocco fan, etc. The airflow generator 215 discharges air from the space R1 inside of the housing 211 toward the outside of the housing 211. Multiple ventilation holes have been formed over the whole surface of the bottom side of the housing 211 to form a suction surface 212. The first suction unit 210 operates the airflow generator 215 to discharge air from the housing 211 shown as "a" in FIG. 16, and generates a suction force shown as "A." This suction force holds the transfer material S upon which the toner image has been transferred against the suction surface 212 resisting the gravitational force. This suction force is strong enough to hold the transfer material S against the suction surface 212, but is not enough to resist the force of the transfer material S being pushed out from the secondary transfer nip portion to hinder the progress of the transfer material S.

The transfer material feed unit 230 generally includes the housing 231 on which the airflow generator 235 such as sirocco fan is disposed and other components such as the transfer material feed member 250 surrounding the housing 231. In the transfer material feed unit 230 the airflow generator 235 discharges air from the space R2 inside the housing 231 toward the outside of the housing 231.

A number of ventilation holes are formed over the whole surface of the bottom side of the housing 231 to form the suction surface 232. With the action "b" of the airflow generator 235, suction "B," as shown, is generated on the suction surface 232. At this time, due to the partitions 233 in the housing 231, the discharge is uniformly distributed from the space R2 inside the housing 231, preventing any variance by location in the suction on the suction surface 232.

The transfer material feed member 250 positioned around the housing 231 is an endless belt with multiple perforated ventilation holes penetrating from one side to the other side (not shown) stretched across the transfer material feed drive roller 251, which applies a driving force to the transfer material feed member 250, and across the transfer material feed stretching rollers 252 and 253. The rotation of the transfer material feed member drive roller 251 causes the transfer material feed member 250 to move to the direction shown by the arrow, and this travelling speed is generally the same speed as the image forming process. The length of the transfer material feed member 250 in the axial direction (the width of the transfer material feed member 250) is configured to be wider than the widest transfer material that the image forming apparatus can handle.

As the suction force exerted on the suction surface 232 of the housing 231 is acted through the ventilation holes of the transfer material feed member 250, the transfer materials transferred with toner is held on the feed surface P of the transfer material feed member 250 resisting the gravitational force. Also, the transfer material S is transported through on the feed surface P, accompanying the movement of the transfer material feed member 250 by the driving force of the transfer material feed member drive roller 251. The feed surface P area between the transfer material feed stretching roller 252 and the transfer material feed member drive roller 251 is used to transport the transfer material S.

The second suction unit 270 includes the airflow generator 275 such as sirocco fan disposed on the housing 271. The airflow generator 275 discharges air from the space R3 inside of the housing 271 toward the outside of the housing 271.

Multiple ventilation holes have been formed over the whole surface on the bottom side of the housing 271 to form the suction surface 272. The action of the airflow generator 275 in the second suction unit 270 discharges air toward the outside of the housing 271, shown as "c," to generate suction "C," as shown. This suction force holds the transfer material S, upon which the toner image has been transferred, against the suction surface 272 resisting the gravitational force. This suction force is strong enough to hold the transfer material S against the suction surface 272, but is not enough to hinder the feed of the transfer material S by resisting the force accompanying the feed of the transfer material S.

The transfer material feed system of this embodiment including the first suction unit 210, the transfer material feed unit 230 and the second suction unit 270, transports the transfer material on which surface the toner image is transferred toward vertically downside.

The blower unit 400 is to blow air into the space between the transfer belt 40 and the secondary transfer roller 61 that is near the exit area from the secondary transfer nip portion. The air is blown into the space R4 inside the housing 401 by the airflow generator 405 such as sirocco fan, etc. The mouth 402 is formed across the housing 401 in the axial direction of the rollers so that with the generation of airflow action "d" from the airflow generator 405, the air sent into the housing 401 is blown out of the mouth 402 as "D," as shown. The force of the air being blown out at this time is adjusted to be enough to keep the transfer material S, upon which the toner image has been transferred, from sagging, but not enough to cause the transfer material S to flutter.

What is claimed is:

1. An image forming method comprising:

feeding a transfer material to a transfer portion by gate roller;

contacting the transfer material with a transfer material grip member that is disposed on a transfer roller;

holding the transfer material on an elastic holding portion that holds the transfer material disposed on the circumference surface of the transfer roller;

transporting the transfer material held by the holding portion; and transferring an image at the transfer portion, such that a leading edge of the transfer material fed by the gate roller abuts the contact position of the transfer material and the transfer material grip member without first intersecting the circumference surface of the transfer roller and at the moment the leading edge of the transfer material abuts the contact position, the other portions of the transfer material do not intersect the circumference circle such that the supply speed of the transfer material is substantially not changed when the leading edge of the transfer material initially abuts the contact position.

2. The image forming method according to claim 1, further comprising:

guiding the transfer material fed by the gate roller by a transfer material feed guide; and contacting the transfer material with the transfer material grip member.

3. The image forming method according to claim 1, wherein the transfer roller including a recessed portion having the transfer material grip member; and contacting the transfer material with the transfer material grip member when the recessed portion moves to the transfer portion and an image carrier is separated from the transfer roller.

4. An image forming apparatus comprising:

an image carrier that carries an image;

a transfer roller that has a holding portion made of an elastic member that comes in contact with the image carrier, a recessed portion on a circumference surface of the transfer roller, a transfer material grip member that is located inside the recessed portion to grip a transfer material, and a support member that supports the transfer material grip member with the transfer material therebetween; and gate roller that feeds the transfer material to a nip portion formed by the contact between the image carrier and the transfer roller; wherein a contact position of the transfer material grip member and the transfer material is set so that an imaginary line between a feeding position of the transfer material by the gate roller and a contact position of the transfer material and the transfer material grip member does not intersect with the circumference surface of the holding portion of the transfer roller such that a leading edge of the transfer material fed by the gate roller abuts the contact position of the transfer material and the transfer material grip member without first intersecting the circumference surface of the transfer roller and at the moment the leading edge of the transfer material abuts the contact position, the other portions of the transfer material do not intersect the circumference circle such that the supply speed of the transfer material is substantially not changed when the leading edge of the transfer material initially abuts the contact position.

5. The image forming apparatus according to claim 4, wherein an intersecting portion between the recessed portion and a surface of the transfer roller has a flat surface.

6. The image forming apparatus according to claim 4, wherein an intersecting portion between the recessed portion and a surface of the transfer roller has rounded surface.

7. The image forming apparatus according to claim 4, wherein positioning of an image to be transferred onto the transfer material is determined by securing the transfer material by the transfer material grip member and the support member.

8. An image forming apparatus comprising:

an image carrier that carries an image;

a transfer roller that has a holding portion made of an elastic member that is formed onto the image carrier, a recessed portion on a circumference surface of the transfer roller, a transfer material grip member that is located inside the recessed portion to grip a transfer material, and a support member that supports the transfer material grip member with the transfer material therebetween;

a gate roller that feeds the transfer material to a nip portion formed by the contact between the image carrier and the transfer roller; and a transfer material feed guide to guide the transfer material fed by the gate roller; wherein when the transfer roller is rotated in a manner in which the transfer material grip member intersect at the point of an imaginary line extended in a direction of feed of the transfer material and the imaginary line passing through the transfer material feed guide, the transfer material feed guide is disposed so that the imaginary line does not intersect with the circumference surface of the holding portion of the transfer roller, such that a leading edge of the transfer material fed by the gate roller abuts a contact position of the transfer material and the transfer material grip member without first intersecting the circumference surface of the transfer roller and at the moment the leading edge of the transfer material abuts the contact position, the other portions of the transfer material do not intersect the circumference circle such that the supply speed of the transfer material is substantially not changed when the leading edge of the transfer material initially abuts the contact position.

* * * * *